US005193687A

United States Patent [19]

Martinez

[11] Patent Number: 5,193,687

[45] Date of Patent: Mar. 16, 1993

[54] GRAVITY SEPARATORS HAVING METALLIC TROUGHS, ESPECIALLY HUMPHREYS SPIRALS

[76] Inventor: Edward Martinez, 13 Bayswater Pl., Chapel Hill, N.C. 27514

[21] Appl. No.: 919,497

[22] Filed: Jul. 24, 1992

Related U.S. Application Data

[63] Continuation of Ser. No. 798,037, Nov. 20, 1991, abandoned, which is a continuation of Ser. No. 606,547, Oct. 31, 1990, abandoned.

[51] Int. Cl.[5] ..... B03C 1/30

[52] U.S. Cl. ..... 209/40; 209/478

[58] Field of Search ..... 209/39, 40, 214, 223.1, 209/232, 458–460, 478, 636

[56] References Cited

U.S. PATENT DOCUMENTS

| | | | |
|---|---|---|---|
| 581,032 | 4/1897 | Pike | 209/478 X |
| 986,389 | 3/1911 | Herr | 209/478 |
| 1,071,839 | 9/1913 | Weatherby | 209/478 |
| 1,885,717 | 11/1932 | Harris | 209/40 |
| 4,565,624 | 1/1986 | Martinez | 209/40 |
| 4,717,469 | 1/1988 | Pirc | 209/214 X |
| 4,902,428 | 2/1990 | Cohen | 209/232 X |

FOREIGN PATENT DOCUMENTS

| | | | |
|---|---|---|---|
| 0282191 | 1/1966 | Australia | 209/478 |
| 0628951 | 10/1978 | U.S.S.R. | 209/40 |
| 2183508 | 6/1987 | United Kingdom | 209/40 |

OTHER PUBLICATIONS

"The Gravity-Magnetic Separator" by E. Martinez, from *Advances in Mineral Processing*, Arbiter Symposium, New Orleans, La., Society of Mining Engineers, Mar. 1986, edited by P. Somasundaran.

Martinez, E. & D. E. Spiller, "The Spiral Gravity-Magnetic Separator", Dec. 1988.

"Gravity-Magnetic Separation Performance Study of Titanium and Iron Ores," Hazen Research, Feb. 23, 1989.

*Primary Examiner*—Donald T. Hajec

*Attorney, Agent, or Firm*—Cohen, Pontani, Lieberman, Pavane

[57] ABSTRACT

A gravity-magnetic separator (10) for concentrating magnetic materials (28), particularly iron, is disclosed. The preferred separator is a cast-iron Humphreys spiral retrofitted with powerful rare earth magnets (22) beneath its separating surface (14), the magnets being sufficiently strong to overcome the shielding effect of the cast-iron spiral and induce a magnetic field at the separating surface of about 60 gauss to about 120 gauss. The resulting gravity-magnetic separator enhances the recovery of iron in a commercially significant way.

38 Claims, 1 Drawing Sheet

GRAVITY SEPARATORS HAVING METALLIC TROUGHS, ESPECIALLY HUMPHREYS SPIRALS

This is a continuation of U.S. application Ser. No. 798,037, filed Nov. 20, 1991, which in turn is a continuation of application Ser. No. 606,547, filed Oct. 31, 1990, both now abandoned.

TECHNICAL FIELD

This invention relates to apparatus for separating magnetic materials from feed materials such as ores, and more particularly to enhancing the recovery of iron in metallic gravity separators through the application of powerful magnetic forces co-directional with the gravity force.

BACKGROUND ART

In conventional gravity separators, differences in the specific gravities of the different components of the feed material are used to accomplish separation. More specifically, a stream of feed material is fed onto a downwardly sloping surface, which may be an inclined plane, cone, or spiral, where it flows under the influence of gravity. The higher specific gravity particles settle near the bottom of the stream while the light materials accumulate near the top. While typically the materials settling near the bottom of the stream represent the valuable part of the ore, that is not always the case. In any event, as is well known in the art, various separating means may be employed to separate the materials settling at the bottom of the stream from those near the top.

In the case of some metallic ores, it is highly beneficial to combine gravity separation with magnetic separation, as disclosed in commonly owned U.S. Pat. No. 4,565,624, the contents of which are incorporated herein by reference in their entirety. This patent discloses a gravity-magnetic ore separator for concentrating magnetic or weakly magnetic minerals having a relatively high specific gravity and utilizes magnetic and gravitational forces acting co-directionally. Under the influence of both magnetic and gravitational forces, magnetic particles are collected more efficiently at the bottom of the sloped surface thereby enhancing recovery and reducing costs.

The patent specifically describes gravity-magnetic separators constructed by modifying conventional gravity separators, such as Reichert cone concentrators or Humphreys spirals. The Humphreys spiral, introduced in 1943, is typically made of cast-iron which shields the feed material from the magnetic forces This problem is emphasized in U.S. Pat. No. 4,565,624 (see col. 7, lines 35–41) wherein it was concluded that it would be impossible to retro-fit a cast-iron spiral with magnets to achieve satisfactory gravity-magnetic separation without first replacing portions of the iron spiral with a non-metallic material. However, the high cost of such replacement has proved an impediment to the modification of the cast-iron Humphreys spiral as a gravity-magnetic separator.

Accordingly, it is an object of the present invention to provide cost effective means for modifying existing gravity separators of the type having a sloping surface made of metal to make them gravity-magnetic separators.

It is a further object of the invention to provide such gravity-magnetic separators without, however, requiring the replacement of portions of the sloping surface with non-metallic material.

DISCLOSURE OF THE INVENTION

Broadly speaking, the present invention comprises an apparatus for separating magnetic material from a feed mixture including non-magnetic material having a lower specific gravity than the magnetic material, the mixture being combined with a non-magnetic fluid for defining a pulp, the apparatus comprising: a downwardly sloped passage having an upper, separating surface and a lower surface, the passage comprising metal and being of a sufficient length to achieve at least partial gravity separation of the magnetic material as the pulp flows downwardly over the separating surface; means for applying a magnetic force beneath the passage as the pulp flows down the separating surface, the magnetic force being sufficiently strong to overcome the shielding effect of the metallic passage to thereby act on the pulp for producing a magnetic force at the separating surface for augmenting the gravity separation by attracting the magnetic material to the separating surface, the magnetic force not being so strong as to cause a build up of magnetic material on the separating surface; and means for separating the magnetic material near the separating surface from the pulp.

In a preferred embodiment of the invention, the magnetic material comprises iron, e.g., magnetite and hematite, the passage comprises a cast-iron Humphreys spiral and the means for applying a magnetic force at the separating surface comprises a plurality of rare earth magnets disposed beneath the separating surface at the lower turns of the Humphreys spiral. The magnets may comprise, for example, neodymium or samarium.

A method in accordance with the present invention is also disclosed. Broadly speaking, the present invention discloses a method for separating magnetic material from a feed mixture also comprising non-magnetic material having a lower specific gravity than the magnetic material, the method comprising: combining the mixture with a non-magnetic fluid thereby forming a pulp; feeding the pulp onto the upper, separating surface of a downwardly sloped passage at the raised feed end thereof, the passage comprising metal and being sufficiently long to achieve at least partial gravity separation of the magnetic material as the pulp flows downwardly over the separating surface; applying a magnetic force beneath the sluice as the pulp flows down the separating surface, the magnetic force being sufficiently strong to overcome the shielding effect of the metallic passage to thereby act on the pulp for producing a magnetic force at the upper surface for augmenting gravity separation by attracting the magnetic material to the separating surface, the magnetic force not being so strong as to cause build up of the magnetic material on the separating surface; and separating the magnetic material near the separating surface from the pulp.

By retrofitting a cast-iron Humphreys spiral in accordance with the invention, recovery of the magnetic material in the feed mixture is enhanced in a commercially significant way, especially considering the relatively minimal cost of retrofitting a cast-iron Humphreys spiral in accordance with the invention. In this regard, once the preferred rare earth magnets are positioned beneath the cast-iron spiral, they are held in place by magnetic attraction, i.e., no special securing means are necessary.

The foregoing as well as further features and advantages of the apparatus and method in accordance with the present invention will be more fully apparent from the following detailed description and annexed drawings of the presently preferred embodiment thereof.

BEST MODE FOR CARRYING OUT THE INVENTION

Figure 1:
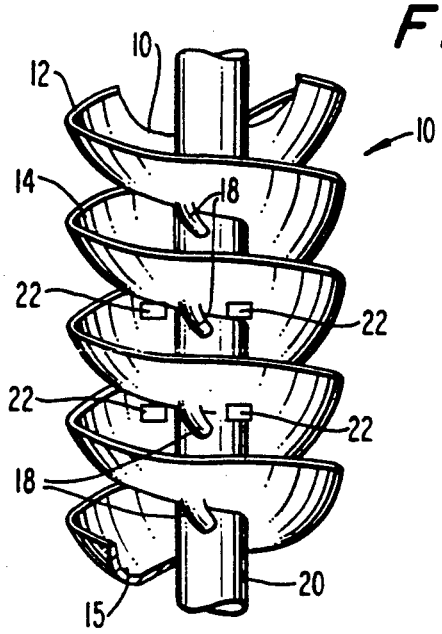
FIG. 1 is an elevational side view of an embodiment of the invention showing a conventional cast-iron Humphreys spiral separator fitted with magnets according to the invention.

The following is a description of a cast-iron Humphreys spiral type gravity separator retro-fitted with magnets in accordance with the invention to achieve gravity-magnetic separation. As shown, the separator 10 includes a multi-turn (e.g. 5 turn) helical sluice having a trough 12 of modified semi-circular cross-section made of cast-iron. The feed material 25, which may comprise an iron ore wherein the iron is in the form of magnetite and hematite, is introduced into trough 12 at the top of the spiral 10 and flows down the trough along separating surface 14. In a typical Humphreys spiral, the trough 12 is cast-iron approximately ⅜ inches thick and the separating surface 14 comprises a rubberized liner approximately ½ inch thick laid in the trough.

As is well known in the art of gravity separation, the heavier fraction 28 of the feed material tends to collect at the bottom of trough 12 nearest the axis of the separator 10 where ports 18 fitted with cutters 19 serve to remove the concentrate. The lighter materials 26, i.e. the non-magnetic matter, tends to accumulate near the top of the trough 12 for ultimate exit as tailings. The highest grade of concentrate is discharged from ports 18 near the top of the spiral, whereas the ports near the lower end of the trough discharge middling. Materials discharged by ports 18 are collected by cylindrical pipe 20 positioned along the axis of the spiral separator 10 whereas the tailings exit the 5 turn spiral 10 at the lower end 15 thereof. In practice, the trough 12 may be filled substantially to the top with feed material 25, though in FIG. 2 it is shown only partially filled for purposes of clarity.

The present invention is intended for use with ores, and particularly iron ores, wherein the heavier fraction 28 comprises a magnetic mineral such that gravity and magnetic forces cooperate to enhance recovery. To create the gravity-magnetic separator of the invention, means 22 for producing a magnetic force are positioned beneath the cast-iron spiral trough 12 at specific locations therealong. In accordance with an important feature of the invention, the means 22 are sufficiently strong to overcome the shielding effect of the cast-iron spiral trough 12 which reduces the magnetic field transmitted to the feed material. Before the present invention, it was the perception in the industry that it was not possible to retro-fit cast-iron spiral separators with magnetic means sufficiently strong to overcome the shielding effect of the cast-iron trough. Rather, and as indicated in the aforementioned U.S. Pat. No. 4,565,624 (see col. 7, lines 35–41), to avoid the shielding effect in the case of the cast-iron spiral, it was contemplated that openings retro-fitted with non-magnetic material would be cut in the trough at locations where the magnets were to be placed.

The present invention provides magnetic means capable of achieving the desired gravity-magnetic separation in a cast-iron spiral without, however, the necessity of cutting openings in the trough. A preferred magnetic means 22 in accordance with the invention capable of overcoming the shielding effect of the cast-iron spiral is powerful permanent magnets. In particular, it was discovered that permanent magnets comprising a rare earth metal, e.g. neodymium or samarium, are capable of overcoming the shielding effect of the cast-iron trough 12 and producing the desired magnetic force. In one embodiment, permanent magnets 22 comprising boron, neodymium and iron may be used. In another embodiment, permanent magnets comprising cobalt and samarium may be used. Both of the above magnets are capable of creating a magnetic field strength in the range of from about 60 gauss to about 120 gauss, and preferably about 90 to about 105 gauss, at the separating surface 14 of the trough 12 along which the feed material 25 flows, whereby the concentrating capability of the cast-iron spiral separator 10 is improved.

In particular, it has been found that if the magnetic field strength at the separating surface 14 is from about 60 gauss to about 120 gauss, and preferably about 90 to about 105 gauss, the resulting magnetic field is sufficiently strong to augment the gravity separation of magnetic minerals, whereby the separator 10 functions as a gravity-magnetic separator for enhancing the separation of the magnetic materials, e.g., magnetite and hematite, from the feed. The above noted upper limit for the magnetic field strength is desirable because at this limit there is satisfactory gravity-magnetic separation without, however, excessive build-up of the magnetic material on the surface 14 above the magnet means 22.

Suitable compositions for rare earth magnets in accordance with the invention are as follows, wherein all components are expressed in percentages by weight:

| I. Neodymium-Boron-Iron (optionally containing dysprosium) | |
|---|---|
| Nd | 30–35% |
| B | 1–2% |
| Dy | 0–5% |
| Fe | 56–59% |
| Other rare earths | 0–2% |
| **II. Samarium-Cobalt** | |
| Sm | 30–40% |
| Co | 60–80% |
| Other rare earths | 0–5% |

Figure 2:
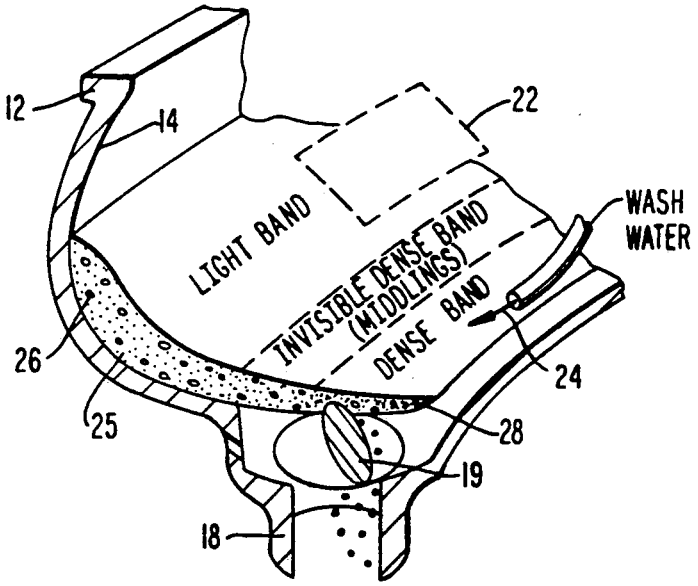
FIG. 2 is an enlarged sectional view of a portion of the trough of the spiral separator of FIG. 1

Referring now to FIG. 2, a portion of the spiral trough 12 and its separating surface 14 down which the feed material 25 flows is shown. The feed material 25 comprises crushed ore and non-magnetic fluid, e.g., water. The resulting density of the feed material is typically about 15%–45% by weight, and preferably about 20%–35%. As shown, and as is known in the art, wash water 24 may be used at various locations along the trough 12 to flush lower density non-magnetic material to the outside of the trough away from the ports 18.

Test Results with Cast-iron Spiral

The following examples illustrate specific application of the invention. However, these examples are not to be construed as limiting the invention or as expressing optimum results.

EXAMPLE I

Figure 3:
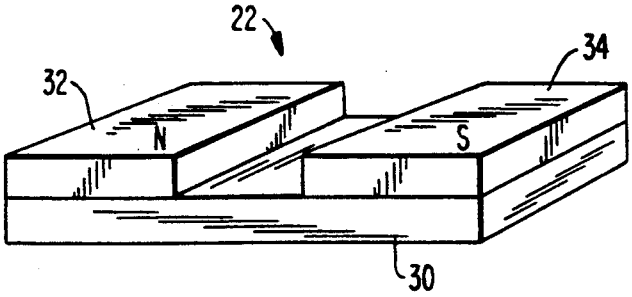
FIG. 3 is a perspective view of a magnet means in accordance with the invention.

Referring to FIG. 3, each magnet means 22 comprised two permanent magnets 32, 34, each 1-inch×2-inch×½-inch thick, joined by a mild-steel plate 30 approximately ¼ inch thick, such that the North pole of magnet 32 and the South pole of magnet 34 face away from the plate 30 and the space between the two magnets is approximately ½-inch. Neodymium-boron-iron magnets from Eriez Magnetics, Erie, Pa. were used. In this example, nine magnet means 22 were used. Each magnet means 22 was secured directly beneath the trough 12 in spaced relation therealong. Specifically, three magnet means 22 were disposed along each of the last three turns of the spiral separator 10 (each turn represents one 360 degree revolution of the trough 12), each magnet means 22 being spaced approximately midway between the nearest two ports 18. In this regard, it has been found that if the magnet means 22 are placed on the upper turns of the spiral separator 10, the flow of feed material is slowed by the attraction of the heavier, magnetic materials to the magnet means 22, with the result being that the recovery and grade of concentrate are reduced.

The magnetic attraction between the magnet means 22 and the cast-iron trough 12 served to secure the magnet means to the trough, i.e. no separate securing means was necessary. Actually, with the thickness of rare earth magnets used, wood or plastic spacers between the magnet means 22 and the trough 12 were used to space the magnets 22 from the undersurface of the trough 12 to produce a magnetic field of approximately 88 to 111 gauss at the separating surface 14 of the spiral separator 10. In this regard, placing the magnets directly adjacent the trough 12, i.e., without spacers, produced a magnetic field intensity too high for effectively recovering iron ore, as the ore would then build up on the surface 14 above the magnets 22 thereby precluding effective separation. Of course, the thickness and dimensions of the rare earth magnets 32 and 34 used affect the magnetic field strength at the separating surface 14. Therefore, it is possible to obtain the desired magnetic field strength without the use of spacers by selecting the proper dimensions of the rare earth magnets.

A sample of iron ore from the Labrador Trough in Canada containing approximately 43.8% total iron ($Fe^T$) by weight was tested. The material was fed to a Humphreys cast-iron spiral without the addition of magnets to determine the recovery and grade of the spiral without modification. A second sample of the same ore was then fed, under conditions as similar as possible to the above-mentioned test, to the spiral 10 to which the nine above-described magnet means 22 had been attached such that readings on the separating surface 14 ranged from 88 to 111 gauss. The cutter or splitter settings on the spiral 10 were those conventionally used in the operating mill from which the sample came. The results are shown in Table A.

TABLE A

Cast-iron Humphreys Spiral Test Results

| | Magnets | |
|---|---|---|
| | Without | With |
| No. Magnets | 0 | 9 |
| Concentrate % | 68.5 | 72.5 |
| $Fe^T$ % in concentrate | 57.4 | 56.0 |
| % Recovery | 89.9 | 94.1 |
| % $Fe^T$ in tailings | 14.1 | 9.2 |
| Feed rate, tph | 2.4 | 2.3 |
| % Solids in feed | 38.1 | 31.4 |

In the above table, "Concentrate %" is the weight percentage of concentrate recovered via the ports 18; "$Fe^T$% in concentrate" is the weight percentage of iron in the concentrate; "% recovery" is the weight percentage of the total iron ($Fe^T$) in the feed material that is contained in the concentrate; "% $Fe^T$ in tailings" is the weight percentage of iron in the tailings; "Feed rate, tph" is the feed rate in short tons per hour; and "% Solids in feed" is the weight percentage of ore in the pulp. The increase of approximately 4% in the recovery of iron obtained by the use of magnet means 22 in accordance with the invention, i.e., 89.9 to 94.1, is a significant one. A Humphreys spiral modified in accordance with the invention improves the economic return significantly.

EXAMPLE II

The same sample as in Example I was fed to the spiral separator 10 but with different cutter settings on the spiral to determine the effect of this variable on separation. Three tests were run in which no magnet means 22 were used and then six and nine magnet means were added, in each case three magnet means 22 to each of the lowermost turns of the separator 10. Gaussmeter readings on the separating surface 14 were again 88 to 111 gauss. The results are shown in Table B wherein it may be seen that adding magnet means 22 invariably increased the rate of iron recovery from the separator 10.

TABLE B

Cast-Iron Humphreys Spiral Test Results

| | Magnets | | |
|---|---|---|---|
| | W/O | With | |
| No. Magnets | 0 | 6 | 9 |
| Concentrate % | 65.4 | 70.7 | 73.6 |
| $Fe^T$ % in concentrate | 59.3 | 56.6 | 58.3 |
| % recovery | 89.9 | 91.6 | 93.2 |
| % $Fe^T$ in tailings | 12.6 | 12.5 | 11.8 |
| Feed rate, tph | 2.2 | 2.4 | 2.3 |
| % Solids in feed | 31.8 | 30.9 | 30.6 |

In lieu of permanent magnets, it may be possible to substitute powerful electromagnets as magnet means 22, provided such electromagnets produce a magnetic field strength at the separating surface 14 in the range of about 60 gauss to about 120 gauss. Such electromagnets would be placed in the same manner as the permanent magnets, though means for securing the electromagnets to the trough 12 should be provided so that when the electromagnets are deactivated, they will not fall. The use of electromagnets is not presently preferred, as sufficiently strong electromagnets would be quite bulky.

It should now be appreciated by those of ordinary skill in the art that while the present invention has been particularly described in connection with the cast-iron Humphreys spiral 10, it could be applied to other types of metallic gravity separators. As this as well additional changes and modifications may be made without departing from the spirit and scope of the invention, the above description should be construed as illustrative and not in a limiting sense, the scope of the invention being defined by the following claims.

What is claimed is:

1. A method for separating magnetic material from a feed mixture also comprising non-magnetic material having a lower specific gravity than said magnetic material, said method comprising the steps of:

combining said mixture with a non-magnetic fluid thereby forming a pulp;

feeding said pulp onto the upper surface of a downwardly sloped passage means at the raised feed end thereof, said passage means comprising metal and being sufficiently long to achieve at least partial gravity separation of said magnetic material as said pulp flows downwardly over said surface;

applying a magnetic force beneath a metal portion of said passage means as said pulp flows down said surface, said magnetic force being sufficiently strong to overcome the shielding effect of said metallic passage means to thereby act on said pulp to produce a magnetic force at said surface for augmenting said gravity separation by attracting said magnetic material to said surface, said magnetic force not being so strong as to cause build up of said magnetic material on said surface; and separating said magnetic material near said surface from said pulp.

2. The method according to claim 1, wherein said passage means comprises a iron Humphreys spiral.

3. The method of claim 2, wherein said step of applying a magnetic force comprises providing beneath said surface at least one magnet at least partially comprising a rare earth metal.

4. The method of claim 2, wherein said Humphreys spiral has a plurality of turns and wherein said step of applying said magnetic force comprises providing at least one magnet means beneath said surface on at least the two lowermost turns of said Humphreys spiral.

5. The method of claim 4, wherein said Humphreys spiral comprises ports at least in said lowermost turns, wherein said step of separating magnetic material from said pulp comprises removing said magnetic material through said ports, and wherein said step of applying said magnetic force comprises providing said magnet means between said ports.

6. The method of claim 5, wherein said step of providing said magnet means comprises providing a plurality of magnet means at each of at least the two lowermost turns of said Humphreys spiral.

7. The method of claim 1, wherein said magnetic force applying step comprises applying a magnetic force sufficient to generate a magnetic field at said upper surface of about 60 gauss to about 120 gauss.

8. The method of claim 7, wherein said magnetic force applying step comprises applying a magnetic force generating a magnetic field at said upper surface of about 90 gauss to about 105 gauss.

9. The method of claim 1, wherein said step of applying a magnetic force comprises providing an electromagnet beneath said surface.

10. The method of claim 1, wherein said magnetic material comprises iron ore.

11. The method of claim 10, wherein said passage means comprises iron.

12. The method of claim 5, wherein said magnetic force applying step comprises applying a magnetic force sufficient to generate a magnetic field at said upper surface of about 60 gauss to about 120 gauss.

13. The method of claim 12, wherein said magnetic force applying step comprises applying a magnetic force generating a magnetic field at said upper surface of about 90 gauss to about 105 gauss.

14. The method of claim 5, wherein said step of applying a magnetic force comprises providing an electromagnet beneath said surface.

15. The method of claim 5, wherein said magnetic material comprises iron ore.

16. The method of claim 15, wherein said passage means comprises cast-iron.

17. The method of claim 16, wherein said at least one magnet means comprises rare earth magnets.

18. An apparatus for separating magnetic material from a feed mixture also comprising non-magnetic material having a lower specific gravity than said magnetic material, said mixture being combined with a non-magnetic fluid for defining a pulp, comprising:

a downwardly sloped passage means having an upper surface and a lower surface, said passage means comprising metal and being of a sufficient length to achieve at least partial gravity separation of said magnetic material as said pulp flows downwardly over said upper surface;

means for applying a magnetic force beneath a metal portion of said passage means as said pulp flows down said upper surface, said magnetic force applying means applying a magnetic force sufficiently strong to overcome the shielding effect of said metallic passage means to thereby act on said pulp to produce a magnetic force at said upper surface for augmenting said gravity separation by attracting said magnetic material to said upper surface, said magnetic force not being so strong as to cause build up of said magnetic material on said upper surface; and means for separating magnetic material near said upper surface from said pulp.

19. The apparatus according to claim 18, wherein said passage means comprises a iron Humphreys spiral.

20. The apparatus of claim 19, wherein said means for applying a magnetic force comprises at least one magnet at least partially comprising a rare earth metal.

21. The apparatus of claim 19, wherein said Humphreys spiral has a plurality of turns and wherein said means for applying said magnetic force comprises at least one magnet means disposed beneath said surface on at least the two lowermost turns of said Humphreys spiral.

22. The apparatus of claim 21, wherein said means for separating said magnetic material from said pulp comprises separating ports at least in said lowermost turns of said Humphreys spiral, and wherein said magnet means are disposed between said ports.

23. The apparatus of claim 22, wherein said magnet means comprises a plurality of magnet means at each of at least the two lowermost turns of said Humphreys spiral.

24. The apparatus of claim 18, wherein said means for applying said magnetic force comprises means for applying a magnetic force sufficient to generate a magnetic field at said upper surface of about 60 gauss to about 120 gauss.

25. The apparatus of claim 24, wherein said means for applying said magnetic force comprises means for applying a magnetic force generating a magnetic field at said upper surface of about 90 gauss to about 105 gauss.

26. The apparatus of claim 18, wherein said means for applying a magnetic force comprises an electromagnet.

27. The apparatus of claim 18, wherein said magnetic material comprises iron ore.

28. The apparatus of claim 27, wherein said passage means comprises iron.

29. The apparatus of claim 21, wherein said means for applying said magnetic force comprises means for applying a magnetic force sufficient to generate a magnetic field at said upper surface of about 60 gauss to about 120 gauss.

30. The apparatus of claim 29, wherein said means for applying said magnetic force comprises means for applying a magnetic force generating a magnetic field at said upper surface of about 90 gauss to about 105 gauss.

31. The apparatus of claim 22, wherein said means for applying a magnetic force comprises an electromagnet.

32. The apparatus of claim 22, wherein said magnetic material comprises iron ore.

33. The apparatus of claim 32, wherein said passage means comprises cast-iron.

34. The apparatus of claim 33, wherein said magnet means comprises rare earth magnets.

35. The apparatus of claim 34, wherein said rare earth magnets comprise neodymium.

36. The apparatus of claim 34, wherein said rare earth magnets comprise samarium.

37. The method of claim 3, wherein said rare earth metal comprise neodymium.

38. The method of claim 37, wherein said rare earth metal comprise samarium.

* * * * *